United States Patent [19]

Takabatake

[11] Patent Number: 4,976,016

[45] Date of Patent: Dec. 11, 1990

[54] SEPARABLE SLIDE FASTENER

[75] Inventor: Hideo Takabatake, Namerikawa, Japan

[73] Assignee: Yoshida Kogyo K.K., Tokyo, Japan

[21] Appl. No.: 430,289

[22] Filed: Nov. 2, 1989

[30] Foreign Application Priority Data

Nov. 8, 1988 [JP] Japan ..... 63-282165

[51] Int. Cl.[5] ..... A44B 19/36

[52] U.S. Cl. ..... 24/433; 24/434

[58] Field of Search ..... 24/433, 434, 435

[56] References Cited

U.S. PATENT DOCUMENTS

| | | | |
|---|---|---|---|
| Re. 18,571 | 8/1932 | Avedon | 24/433 |
| 2,037,473 | 4/1936 | Legat . | |
| 2,098,338 | 11/1937 | Gilmore | 24/434 |
| 2,114,747 | 4/1938 | Murphy | 24/433 |
| 2,502,885 | 4/1950 | Poux | 24/433 |
| 2,600,905 | 6/1952 | Morin . | |
| 3,377,668 | 4/1968 | Carlile et al. | 24/434 |
| 4,414,718 | 11/1983 | Kumano . | |
| 4,586,220 | 5/1986 | Ogura et al. | 24/433 |

FOREIGN PATENT DOCUMENTS

| | | |
|---|---|---|
| 0158837 | 3/1983 | European Pat. Off. . |
| 980925 | 5/1951 | France . |
| 1049835 | 1/1954 | France . |
| 450030 | 4/1968 | Switzerland . |

*Primary Examiner*—Victor N. Sakran

*Attorney, Agent, or Firm*—Hill, Van Santen, Steadman & Simpson

[57] ABSTRACT

A separable slide fastener comprises a pair of opposed stringers each carrying along one of their longitudinal edges a row of coupling elements in a meandering or zig-zag form, a slider movable reciprocably along the stringer to couple and uncouple the rows of elements thereon, and a bottom-end-stop assembly comprising a socket attached to the stringer, a socket pin integral with the socket and a guide pin attached to the other stringer. The guide pin has an opening in its thickened upper end for receiving a coupling head of a lowermost terminal element on the stringer and a pocket in the lower portion of the opening dimensioned to receive a lower hook portion of the terminal element coupling head with a tight fit.

6 Claims, 3 Drawing Sheets

SEPARABLE SLIDE FASTENER

BACKGROUND OF THE INVENTION

1. Field of the Invention

This invention relates to slide fasteners and more particularly to a separable type slide fastener suitable for use in jackets and the like garment article to facilitate the removal thereof from the user. The invention is more specifically directed to a separable slide fastener of the type carrying coupling element rows in a meandering or zig-zag formation.

2. Prior Art

Various separable slide fasteners have been proposed, a typical example of which is provided with a separable bottom-end-stop assembly including a pin member attached to one of a pair of fastener stringers and a socket member to the other stringer, the pin being releasably engageable with the socket to join the respective lower ends of the stringers. Such known separable bottom-end-stop assemblies were successful when applied to slide fasteners carrying coupling elements of a helical coil structure, but were not very satisfactory when applied to slide fasteners having meander or zig-zag shaped continuous coupling elements mounted astride both sides of the fastener tapes. This is because more stresses would be required for the latter type of fastener to bend or flex along an axis vertical to the plane of the fastener with the results that the fastener stringers once coupled together are, when such stresses are exerted, apt to separate unintentionally starting with the first terminal or lowermost one of the coupling elements immediately adjacent the bottom-end-stop assembly. Such unintentional separation of the stringers is often referred to as "chain crack".

To cope with the above "chain crack" problem, there has been proposed a separable slide fastener, as disclosed in U.S. Pat. No. 3,377,668, in which a separable bottom-end-stop assembly has a pin member on one stringer and a socket with pin on the other stringer, the pin member including a projection arranged to come under and engage the lower portion of a coupling head of the lowermost coupling element contiguous with the socket pin. This arrangement is effective in combating lateral pull on the fastener but not quite for overcoming stresses tending to flex the fastener laterally across inasmuch as the projection merely rests underneath the coupling head of the coupling element. To further assure retention of the lowermost element with respect to the projection of the pin member, there is provided in the socket pin a groove configured to receive a corresponding rail-like portion of the pin member with a tight interlocking fit. This arrangement is not only costly but also would involve increased resistance to sliding coupling and uncoupling of the pin and socket members.

SUMMARY OF THE INVENTION

It is therefore the primary object of the present invention to provide a separable slide fastener with a separable bottom-end-stop assembly having a pin and a socket member which can be engaged and disengaged with utmost ease and which incorporates structural features such that the lowermost fastener element can be steadily retained in place against severe lateral pull and bending stresses which would otherwise cause "chain crack".

A more specific object of the invention is to provide a separable bottom-end-stop assembly which is suitable for use with a slide fastener having a meander or zig-zag formation of fastener elements.

According to the invention, there is provided a separable slide fastener comprising a pair of opposed stringers each including a tape and a row of coupling elements secured along one longitudinal edge of the tape, and each of the coupling elements having a coupling head with upper and lower hook portions, a slider movable reciprocably on and along the pair of stringers, and a separable bottom-end-stop assembly comprising a socket member fixedly connected to a lower end portion of one the stringer, a socket pin member integral with and projecting from the socket member and a guide pin member fixedly connected to a lower end portion of the other stringer and releasably engageable with the socket member, the guide pin has a bulged upper end portion which is beveled to provide a cross-sectionally semi-circular opening for receiving the coupling head of a lowermost terminal element in the row of elements on the stringer.

The above and other objects and features of the invention will become manifest from the following detailed description of certain preferred embodiments taken in conjunction with the accompanying drawings.

DETAILED DESCRIPTION

Figure 1:
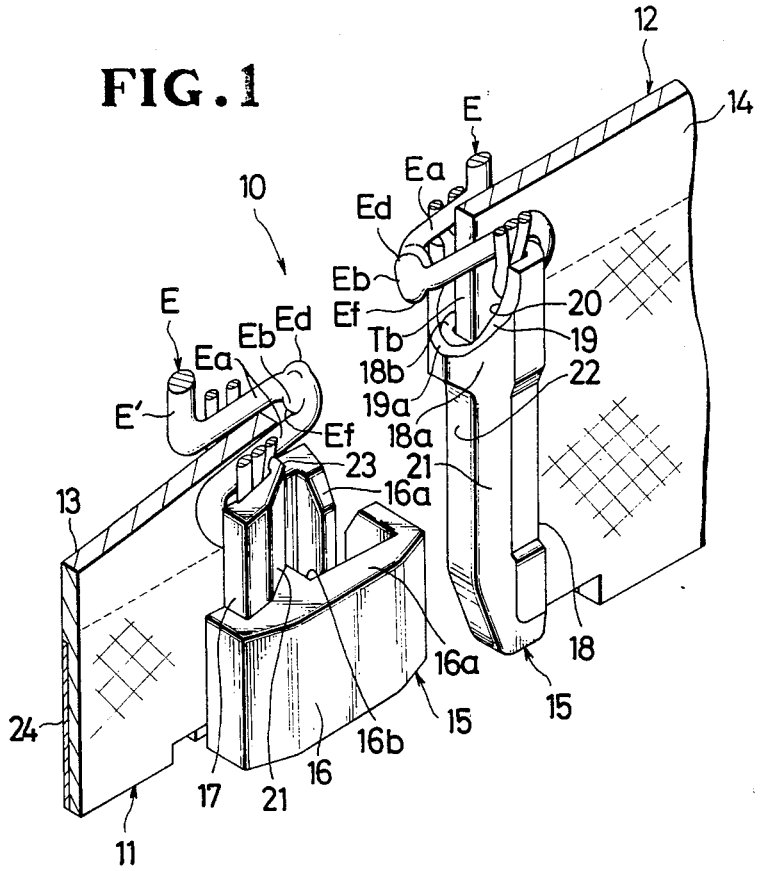
FIG. 1 is a perspective view of a segmentary bottom end portion of a separable slide fastener, showing a separable bottom-end-stop assembly.

Referring now to the drawing and FIG. 1 in particular, there is shown a separable slide fastener 10 embodying the invention. The fastener 10 comprises a pair of stringers 11, 12 each including a row of meandering coupling elements E mounted (secured as by two-thread chain stitches) astride an inner longitudinal edge of a support tape 13 (14). Each individual element E in a continuous row extending in a ladder-like fashion longitudinally of the tape 13 (14) consists of a pair of leg portions Ea, Ea superposed across the tape edge portion, a coupling head portion Eb and a shank portion Ec merging with leg portions Ea, Ea of adjacent elements E. The coupling head Eb on one tape 13 is flattened out or otherwise deformed to provide upper and lower hook portions Ed and Eb projecting beyond the inner tape edge and releasably interengageable with corresponding portions of the coupling head Eb in confronting relation on the other tape 14.

A bottom-end-stop assembly generally designated at 15 and fabricated from suitable thermoplastic material comprises a socket member 16 fixedly connected to the inner edge of the lower or bottom end portion Ta of one stringer 11, a socket pin member 17 integral with the socket member 16 and projecting therefrom parallel to the plane of the tape 13 and a guide pin member 18 fixedly connected to the inner edge of the bottom end portion Ta of the other stringer 12. The guide pin 18 is somewhat longer and extends at both of its ends beyond the ends of the socket pin 17.

The socket member 16 has a pair of opposed flanges **16*a*, 16*a* respectively clamped on opposite surfaces of the bottom end portion of the tape 13 and defining therebetween a cavity 16*b* for receiving the guide pin 18**.

Figure 2:
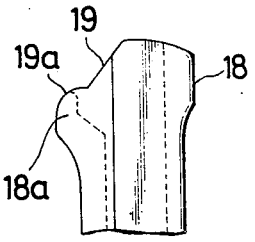
FIG. 2 is a modified form of a portion of a guide pin member constituting part of the stop assembly.
Figure 4:
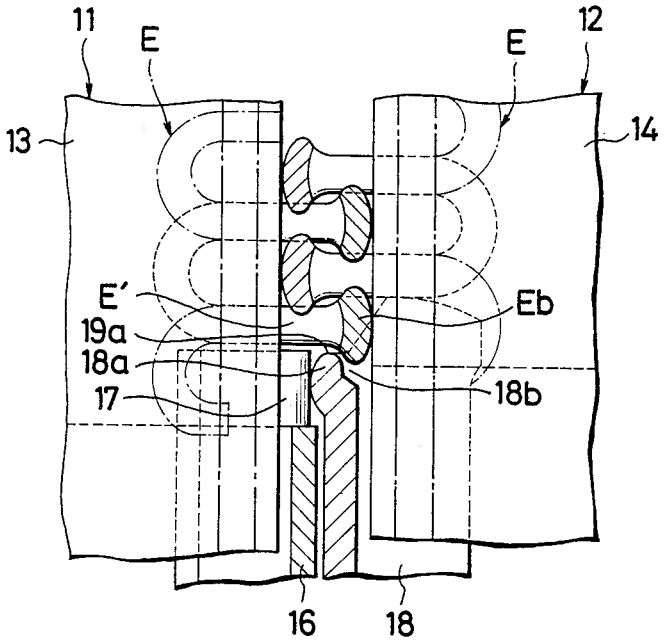
FIG. 4 is a plan, partly sectional, view of a bottom end portion of the fastener of FIG. 1 shown in closed disposition.
Figure 5:
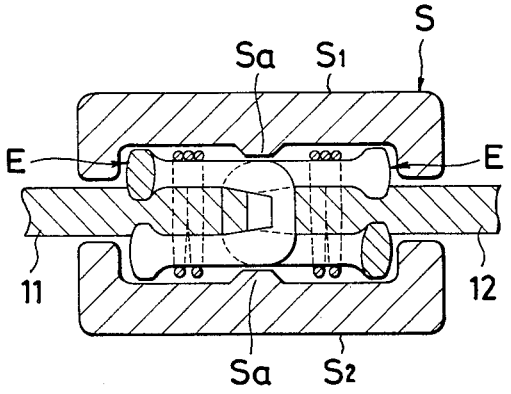
FIG. 5 is a transverse cross-sectional view of the fastener with a slider mounted thereover.

The guide pin member 18 on the left-hand stringer 14 has a bulged or thickened upper end portion **18*a* which is beveled as at 19 to provide a cross-sectionally semicircular opening 18*b* defined by an inner peripheral wall 18*c* and revealing a portion of an inner tape edge Tb. The opening 18*b* is adapted to receive the coupling head Eb of the lowermost terminal element E' extending integrally from the socket pin 17 on the right-hand stringer 13. More specifically, there is formed a pocket 20 in the beveled bulged upper end portion 18*a* of the guide pin 18, which pocket 20 is defined by a lower beveled peripheral edge 19*a* and the portion of the inner tape edge Tb which is disposed in the opening 18*b*. The pocket 20 is dimensioned to fully receive the lower hook portion Ef of the coupling element E with a tight fit, whilst the upper hook portion Ed engages the next adjoining element E as in normal coupling operation. The beveled marginal edge 19 of the pocket 20 is formed somewhat arcuately as shown in FIG. 1, but can be straight as shown in FIG. 2. In either case, however, it is preferable to round off the lower portion 19*a* of the beveled edge 19 so as to ensure friction-free reception of the coupling head Eb of the lowermost element E' in the pocket 20**.

Figure 3:
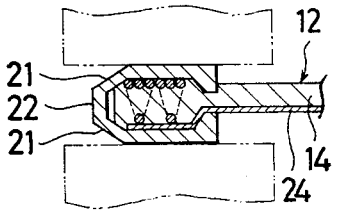
FIG. 3 is a transverse cross-sectional view of the guide pin member.

As shown in FIG. 1 and better in FIG. 3, the guide pin member 18 is tapered laterally inward from both of its sides as at 21 to provide an abutment wall 22 of reduced thickness. The socket pin 17 is likewise tapered to provide a similar abutment wall 23 for abutting engagement with the wall 22 of the guide pin 18. This arrangement ensures smooth and easy insertion and removal of the guide pin 18 into and out of the cavity **16*b* of the socket member 16**.

Figure 6:
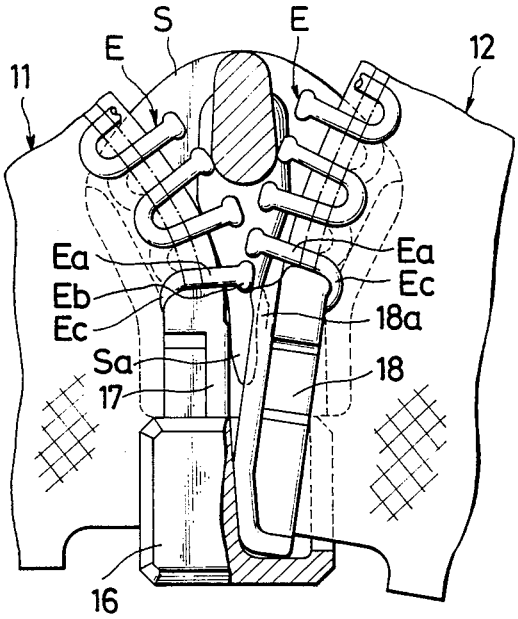
FIG. 6 is a plan view similar to FIG. 4 but showing the manner of inserting the guide pin member through a slider.
Figure 7:
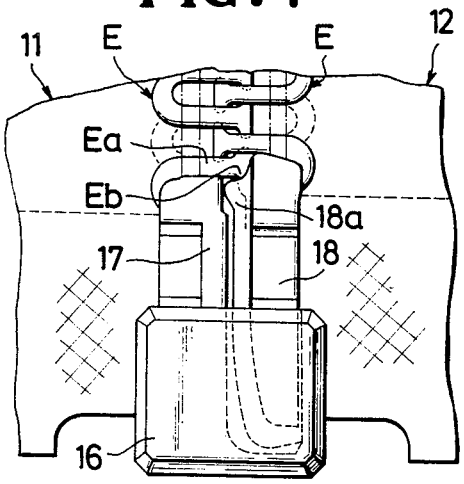
FIG. 7 is a plan view similar to FIG. 6 but showing the guide pin fully engaged with the socket member.

With this construction, when coupling together the two confronting stringers 11 and 12 coupled together by a slider S is first brought over the socket pin 17 of the socket member 16 and then the guide pin 18 is threaded into the guide channel of the slider S in a well known manner. The guide pin 18 is inserted into the slider S at an oblique angle to the longitudinal axis of the fastener 10 such that there occurs no interference between the opposed coupling elements E and further into the cavity **16*b* of the socket member 16, in which instance the lower hook portion Ef of the lowermost element E' partly overlies the lower beveled edge 19*a* of the pocket 20 as shown in FIG. 6**.

As the slider S is moved upwardly from this position, the lower hook portion Ef of the element E' slides over the edge **19*a* into the pocket 20, at which time point the guide pin member 18 is fully inserted into and lies parallel with the socket member 16, with the abutment walls 22, 23 of the respective members held in abutting engagement with each other. In this disposition of the slide fastener 10. The coupling head Ea, its lower hook portion Ef in particular of the lowermost or terminal element E' is fully anchored in the pocket 20 inter alia and partly supportedly embedded by the inner peripheral wall 18*c* of the opening 18*b* so that the terminal element E' is firmly retained in place relative to an adjacent element E immediately above the guide pin 18** thereby ensuring smooth, effective interengagement of the rest of the elements upon movement of the slider upwardly along the tape edge.

To ensure proper alignment of the opposed coupling elements E during the coupling operation of the slider S, there is provided an inwardly directed projection Sa which is formed centrally of each of the upper and lower wings S1 and S2 of the slider S and which serves to guide and hold the coupling heads Eb of the elements E against vertical displacement. The provision of such projections Sa is made possible by virtue of tapering both guide pin 18 and socket pin 17 as illustrated, which tapering is also effective in eliminating cracks or damage which would otherwise often take place when clamping the conventional flat surfaced pin members.

Designated at 24 is a reinforcement strip made of plastics film, adhesive tuft or the like which is secured to the bottom end regions of the tapes 13, 14 at which the bottom-end-stop assembly 15 is attached.

Obviously, various modifications and variations of the present invention are possible in the light of the above teaching. It is therefore to be understood that within the scope of the appended claims the invention may be practiced otherwise than as specifically described.

What is claimed is:

1. A separable slide fastener comprising a pair of opposed stringers each including a tape and a row of coupling elements secured along one longitudinal edge of said tape, and each of said coupling elements having a coupling head with upper and lower hook portions, a slider movable reciprocably on and along said pair of stringers, and a separable bottom-end-stop assembly comprising a socket member fixedly connected to a lower end portion of one said stringer, a socket pin member integral with and projecting from said socket member and a guide pin member fixedly connected to a lower end portion of the other said stringer and releasably engageable with said socket member, said guide pin having has a bulged upper end portion which is beveled to provide a cross-sectionally semi-circular opening for receiving the coupling head of a lowermost terminal element in said row of elements on one of said stringers.

2. A separable slide fastener according to claim 1 wherein said bulged portion of the guide pin includes an arcuately beveled peripheral edge.

3. A separable slide fastener according to claim 1 wherein said bulged portion includes a pocket defined by a lower portion of said beveled edge and an inner edge portion of said tape for receiving the lower hook portion of said terminal element.

4. A separable slide fastener according to claim 1 wherein said socket pin member and said guide pin member are tapered laterally inward to respectively provide abutment walls of reduced thickness.

5. A separable slide fastener according to claim 1 wherein said coupling elements are in a meandering formation such that they are mounted astride inner longitudinal edges of the respective tapes.

6. A separable slide fastener according to claim 3 wherein said lower portion of said beveled edge is rounded off.

* * * * *